US006435245B1

(12) United States Patent
Sette et al.

(10) Patent No.: US 6,435,245 B1
(45) **Date of Patent: *Aug. 20, 2002**

(54) SYSTEM FOR FOLDING AND TABBING SHEETS

(75) Inventors: Paul R. Sette, Branford; Richard A. Sloan, Jr., Southbury, both of CT (US)

(73) Assignee: Pitney Bowes Inc., Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/442,561

(22) Filed: Nov. 18, 1999

(51) Int. Cl.[7] ..... B65C 9/06

(52) U.S. Cl. ..... 156/475; 156/384; 156/442.1; 156/479; 156/556

(58) Field of Search ..... 156/442, 447.1, 156/442.2, 443, 202, 216, 483, 542, 364, 384, 475, 479, 556; 271/225; 270/37, 45

(56) References Cited

U.S. PATENT DOCUMENTS

| | | | | | |
|---|---|---|---|---|---|
| 1,813,476 | A | | 7/1931 | Waterwoth | 493/419 |
| 2,594,316 | A | | 4/1952 | Krueger et al. | 216/23 |
| 3,265,382 | A | * | 8/1966 | Sherman | 270/45 |
| 3,436,294 | A | | 4/1969 | Marano | 156/351 |
| 3,527,635 | A | | 9/1970 | Paulsen et al. | 156/361 |
| 3,535,186 | A | | 10/1970 | De La Coussaye | 156/355 |
| 4,003,780 | A | | 1/1977 | Cohn | 156/519 |
| 4,160,687 | A | * | 7/1979 | Spear | 156/444 |
| 5,082,272 | A | | 1/1992 | Xydias et al. | 271/186 |
| 5,088,712 | A | | 2/1992 | Luperti | 270/95 |
| 5,192,389 | A | | 3/1993 | Martin | 156/364 |
| 5,196,083 | A | | 3/1993 | Baker et al. | 156/364 |
| 5,279,698 | A | * | 1/1994 | Davis | 156/483 |
| 5,281,296 | A | | 1/1994 | Beliveau | 156/542 |
| 5,310,174 | A | | 5/1994 | Thomas | 271/225 |
| 5,338,387 | A | | 8/1994 | Noll | 156/441.5 |
| 5,417,783 | A | | 5/1995 | Boreali et al. | 156/64 |
| 5,441,244 | A | | 8/1995 | Bartoes et al. | 270/45 |
| 5,449,166 | A | * | 9/1995 | Lohmann et al. | 271/225 |
| 5,482,593 | A | | 1/1996 | Kuhn et al. | 156/521 |
| 5,514,066 | A | | 5/1996 | Monaco | 493/25 |
| 5,520,603 | A | | 5/1996 | Bluthardt et al. | 493/421 |
| 5,547,175 | A | * | 8/1996 | Grushar et al. | 270/37 |
| 5,690,325 | A | | 11/1997 | Morimoto | 271/65 |
| 5,711,846 | A | * | 1/1998 | Alicea | 156/483 |

(List continued on next page.)

OTHER PUBLICATIONS

U.S. patent application Ser. No. 09,442,552, entitled "Method and System for Tabbing Folded Material", filing date: Nov. 18, 1999.

*Primary Examiner*—Michael W. Ball
*Assistant Examiner*—Todd J. Kilkenny
(74) *Attorney, Agent, or Firm*—Michael J. Cummings; Angelo N. Chaclas

(57) ABSTRACT

A method and system for producing a self-mailer using a folding apparatus for folding sheets into folded materials and a tabbing apparatus for sealing the folded materials with tabs in a continuous flow. Typically a folded material exits the folded apparatus with the open end of the folded material leading and this traveling direction of the folded material is not suitable for tabbing. A path directing apparatus is placed between the folding apparatus and the tabbing apparatus so as to cause the folded material to enter the tabbing apparatus with the open end of the folded material leading. As such, the entire process can be carried out without manually reversing the traveling direction of the folded material. In addition, a printer and a labeling device can be added to the self-mailer producing system to put on an address label, a postage indicia and a return address while keeping the process steps in a continuous flow.

15 Claims, 10 Drawing Sheets

U.S. PATENT DOCUMENTS

| | | | | |
|---|---|---|---|---|
| 5,735,101 | A | 4/1998 | Lam | 53/136.1 |
| 5,768,959 | A | 6/1998 | Lorenzo | 83/74 |
| 5,769,774 | A | 6/1998 | Beck et al. | 493/421 |
| 5,785,638 | A | 7/1998 | Bristo et al. | 493/420 |
| 5,802,808 | A | 9/1998 | Lyga | 53/381.5 |
| 5,813,327 | A | 9/1998 | Freeman et al. | 101/93 |
| 5,816,570 | A | 10/1998 | Paradis et al. | 271/179 |
| 5,816,715 | A | 10/1998 | Harman et al. | 400/71 |
| 5,818,724 | A | 10/1998 | Brewster, Jr. et al. | 364/478.08 |
| 5,833,232 | A | 11/1998 | Ifovits et al. | 271/225 |
| 5,887,868 | A | 3/1999 | Lambert et al. | 271/186 |
| 6,006,210 | A | 12/1999 | Freeman et al. | 705/402 |
| 6,090,034 | A | 7/2000 | Jaksch | 493/478 |
| 6,206,817 | B1 | 3/2001 | Sette et al. | 493/421 |
| 6,244,590 | B1 | 6/2001 | Williams | 271/184 |
| 6,244,591 | B1 | 6/2001 | Paulat | 271/225 |

* cited by examiner

SYSTEM FOR FOLDING AND TABBING SHEETS

CROSS REFERENCE TO RELATED APPLICATIONS

Reference is made to application Ser. No. 09/442,559, entitled METHOD AND SYSTEM FOR DIRECTING AN ITEM THROUGH THE FEED PATH OF A FOLDING APPARATUS, assigned to the assignee of this application and filed on even date herewith.

Reference is made to application Ser. No. 09/442,552, entitled METHOD AND SYSTEM FOR TABBING FOLDED MATERIAL, assigned to the assignee of this application and filed on even date herewith.

Reference is made to application Ser. No. 09/442,551, entitled METHOD AND APPARATUS FOR FOLDING SHEETS, assigned to the assignee of this application and filed on even date herewith.

TECHNICAL FIELD

The present invention is generally related to a self-mailer producing apparatus and, more specifically, to a method and apparatus for controlling the traveling direction of a piece of folded material exiting a folding machine.

BACKGROUND OF THE INVENTION

A self-mailer is conventionally defined as a mailpiece without an envelope. The self-mailer usually contains one or more sheets of printed material, folded once or twice by a folding machine into a smaller piece for mailing. Typically the folded material has a folded end and an open end. The open end is sealed with one or more tabs before the self-mailer is sent to the addressee. In addition, it may be required that an address label and a postage stamp or indicia be applied to or printed on the folded material. Thus, the components of a self-mailer producing system can generally be grouped into a printer, a folding machine, a labeler and a tabbing device.

Folding machines are well-known. For example, U.S. Pat. No. 4,701,233 (Beck et al.) discloses a method of folding a sheet by bulging a portion of the sheet and then folding the bulged portion through a roller nip. U.S. Pat. No. 4,875,965 (Marzullo) discloses a folding apparatus where a buckle chute is used for stopping a sheet, causing the sheet to enter a roller nip for folding. U.S. Pat. No. 4,944,131 (Gough) also discloses a folding apparatus having a buckle chute. With the above-identified folding machines, when the folded material exits the folding machine, it travels in the direction of the fold. This means that the folded end is leading the open end. Folding machines are generally designed for folding enclosure material to be inserted into envelopes in an envelope inserting device. In this particular application, the traveling direction of the folded material is not very important. But for tabbing purposes, it is desirable that the folded material travels with the open end leading the folded end. Thus, while the traveling direction of the folded material exiting a folding machine is suitable for envelope insertion, it is not suitable for tabbing.

Tabbing devices are also well-known. U.S. Pat. No. 5,711,846 (Alicea) discloses a tabbing device having precut tabs arranged in a roll on a narrow strip of removable backing material, wherein each tab is partially peeled away from the backing material, thereby exposing the adhesive side of the tab to the folded material to be sealed.

In a typical tabbing device, the tab faces an incoming piece of folded material so that the tab can be applied to the leading edge of the folded material. Furthermore, the tab must be applied to the open end of the folded material. Thus, when a piece of folded material is fed to a tabbing device, the leading edge of the folded material must be the open end, and not the folded end. In that case, the folded material exiting a folding machine must be rotated by hand so that the open end leads the folded end, before the folded material is fed to the tabbing apparatus for tabbing. This manual step can be time-consuming and increases the cost of producing self-mailers.

It is advantageous and desirable to provide a method and an apparatus for tabbing and folding sheets without manually rotating the folded material.

Furthermore, before or after the folded material is sealed, it can be moved through a printer for printing a postage indicia and/or an address thereon. Alternatively, a labeler can be used to apply an address label on the folded material. Labelers are well-known. An exemplary labeler is disclosed in U.S. Pat. No. 4,294,644 (Anderson). The disclosed labeler uses a servo motor to drive the label feed, wherein the label feed contains precut labels arranged in a roll on a backing material.

SUMMARY OF THE INVENTION

The system for producing self-mailers, according to the present invention, comprises: a folding apparatus for folding sheets into folded pieces and each folded piece has an open end and an opposing end, wherein the folding apparatus has an exit end; a tabbing apparatus, having an input end, for sealing the folded piece at the open end thereof in order to produce a self-mailer, and a path directing apparatus located between the exit end of the folding apparatus and the input end of the tabbing apparatus for directing the path of the folded material so as to cause the folded piece to enter the input end of the tabbing apparatus with the open end leading the opposing end.

Furthermore, the self-mailer producing system may include a printer to print a postage indicia and a labeling device to apply an address label on the folded piece. The printer and the labeling device can be located upstream or downstream from the tabbing apparatus to form a continuous path for the folded material. As such, the folding, sealing, printing and addressing steps necessary to produce a self-mailer can be carried out in a continuous flow without interruption.

Accordingly, in a system for producing self-mailers wherein the system has a folding apparatus for folding sheets into folded pieces with each folded piece having an open end and an opposing end, and a tabbing apparatus for applying a tab on the open end in order to seal each folded piece, the method for providing a continuous path between the folding apparatus and the tabbing apparatus comprises the step of directing the path of the folded piece so as to cause the folded piece to enter the tabbing apparatus with the open end leading the folded end. Typically the end opposing to the open end of a folded material is a folded end.

BRIEF DESCRIPTION OF THE DRAWINGS

The present invention will become apparent upon reading the description taken in conjunction with FIG. 1 to FIG. 7B.

DETAILED DESCRIPTION

Figure 1:
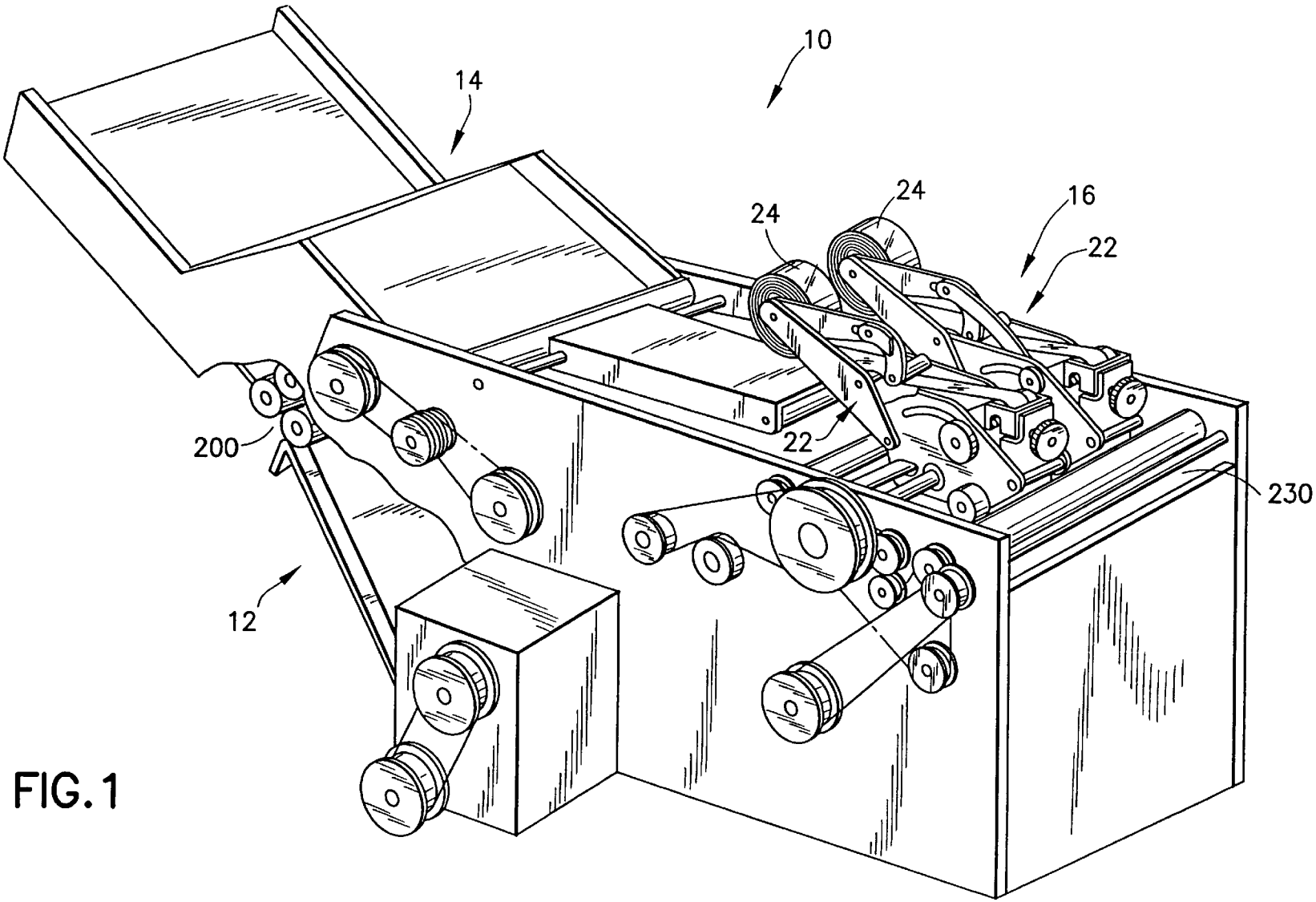
FIG. 1 is a perspective view of a self-mailer producing system, according to the present invention, showing the relative position of the tabbing apparatus to the folding apparatus.

Referring now to FIG. 1, a self-mailer producing system 10, according to the present invention, comprises a folding apparatus 12, a tabbing apparatus 16 and a path directing apparatus 14 positioned between the folding apparatus 12 and the tabbing apparatus 16. Folding apparatus 12 is used to fold one or more sheets of paper or documents 100 (FIG. 3) fed through the entrance 200 of the folding apparatus 12. Typically, after being folded by the folding apparatus 12, the folded material 110 (FIG. 3) has an open end 114 (FIG. 3) needed to be sealed by the tabbing apparatus 16. If the folded material 110 exits the folding apparatus 12 with the open end 114 trailing, it must be turned around or flipped over before the folded material 114 is fed into the tabbing apparatus 16. For the purpose of re-orienting the folded material 110 so that the open end 114 of the folded material 110 is leading when the folding material 110 is fed into the tabbing apparatus 16, the path directing apparatus 14 is placed between the exiting end 202 (FIG. 4) of the folding apparatus 12 and the input end 220 (FIG. 4) of the tabbing apparatus 16. After being sealed, the folded material 110 exits the self-mailing producing system 10 through the exit end 230. Also shown in FIG. 1 are two tape feeders 22 on the tabbing apparatus 16, wherein each tape feeder 22 has a roll of tape 24 for providing tabbing material to seal the folded materials 110.

Figure 2:
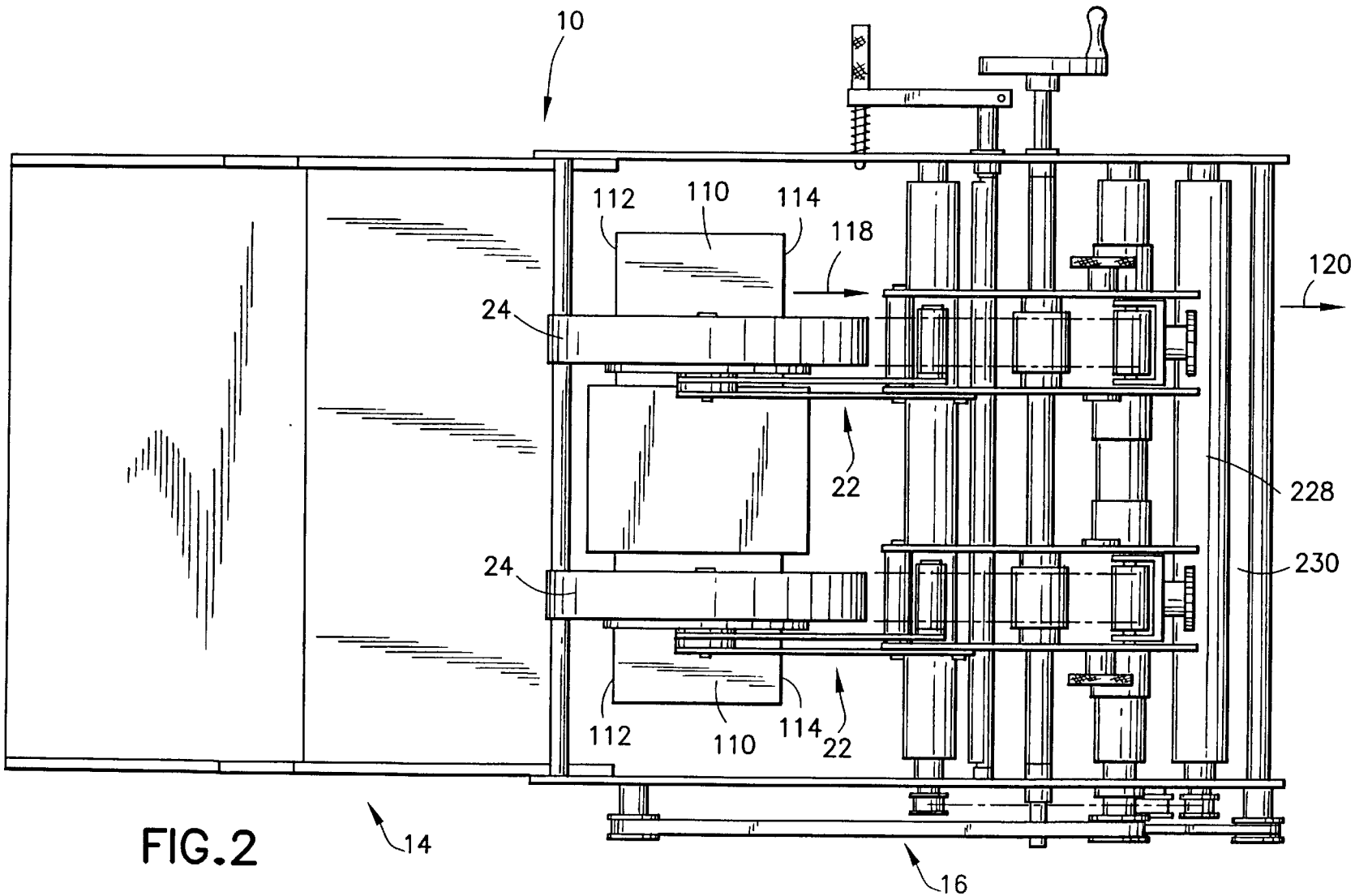
FIG. 2 is a top view of the self-mailer producing system, showing the path between the path directing apparatus and the tabbing apparatus.

FIG. 2 is a top view of the self-mailer producing system 10. As shown, a piece of folded material 110 is moved from the path directing apparatus 14 toward the tabbing apparatus 16 along a direction indicated by an arrow 118. The folding material 110 has an open end 114 leading the opposing end 112 which is usually a folded end. When the folded material 110 reaches a tabbing point 228 of the tabbing apparatus 16, each of the tape feeders 22 cuts a section of the tape from the roll 24 to seal the open end 114 before the folded material 110 exits the self-mailer producing system 10 from the exit end 230 along a direction indicated by an arrow 120.

Figure 3:
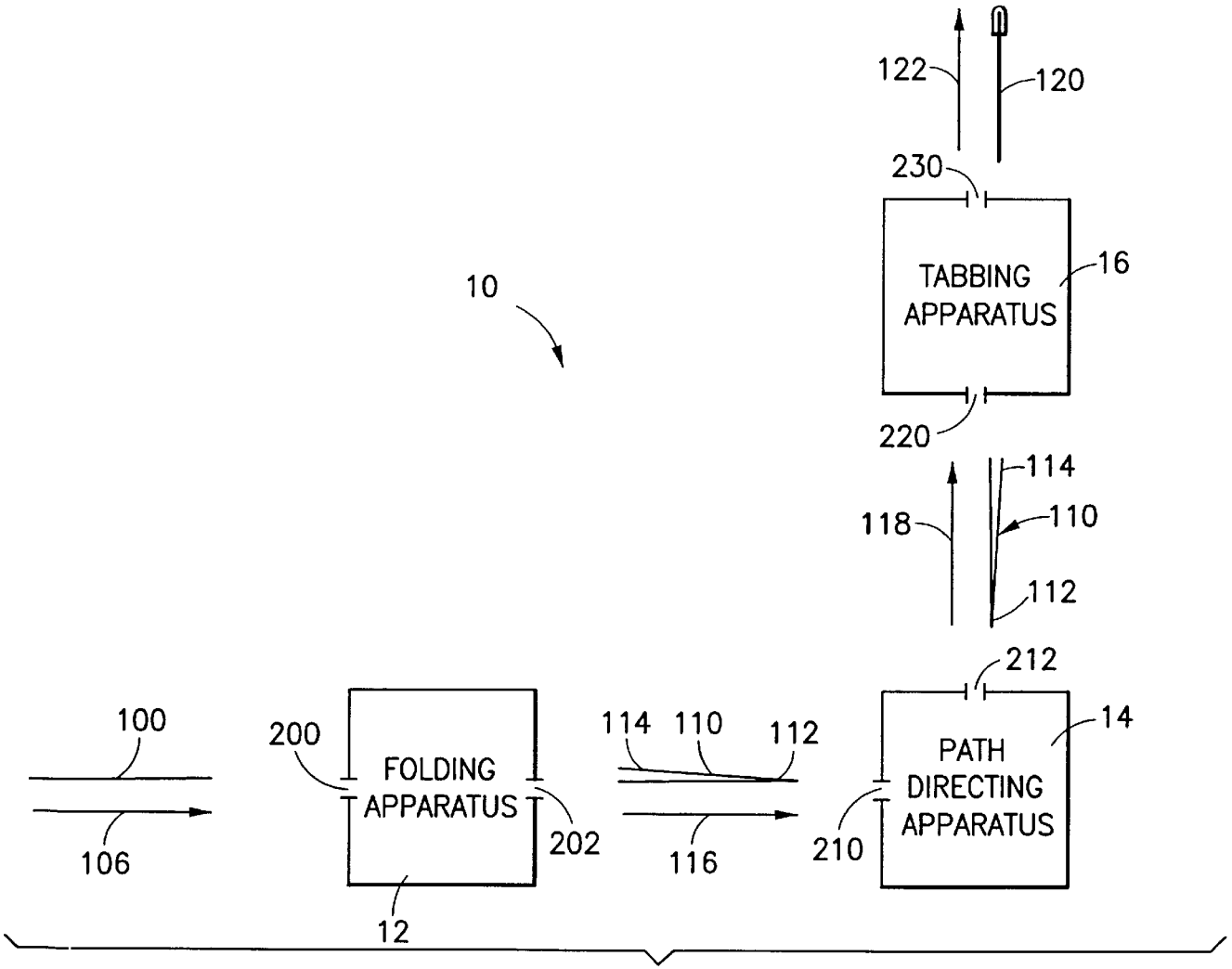
FIG. 3 is a block diagram illustrating the necessary processing steps for producing a self-mailer, showing the path from the input end of the folding material to the exit end of the tabbing apparatus.

As shown in FIG. 3, one or more sheets of unfolded material 100 are moved along a direction indicated by an arrow 106 through the entrance 200 of the folding apparatus 12. The unfolded material 100 is folded into a piece of folded material 110, which exits the exit end 202 of the folding apparatus 12 with the folded end 112 of the folded material 110 leading the open end 114. The folded material 110 is further moved along a direction indicated by an arrow 116 into an entrance 210 of the path directing device 14. After emerging from an exit 212 of the path directing apparatus 14, the folded material 110 is moved along the direction 118, with the open end 114 leading the folded end 112. After entering through an entrance 220 and exiting through the exit end 230 of the tabbing apparatus 16, the folded material 112 is sealed, as denoted by reference numeral 120, and moves along a direction indicated by an arrow 122.

Figure 4:
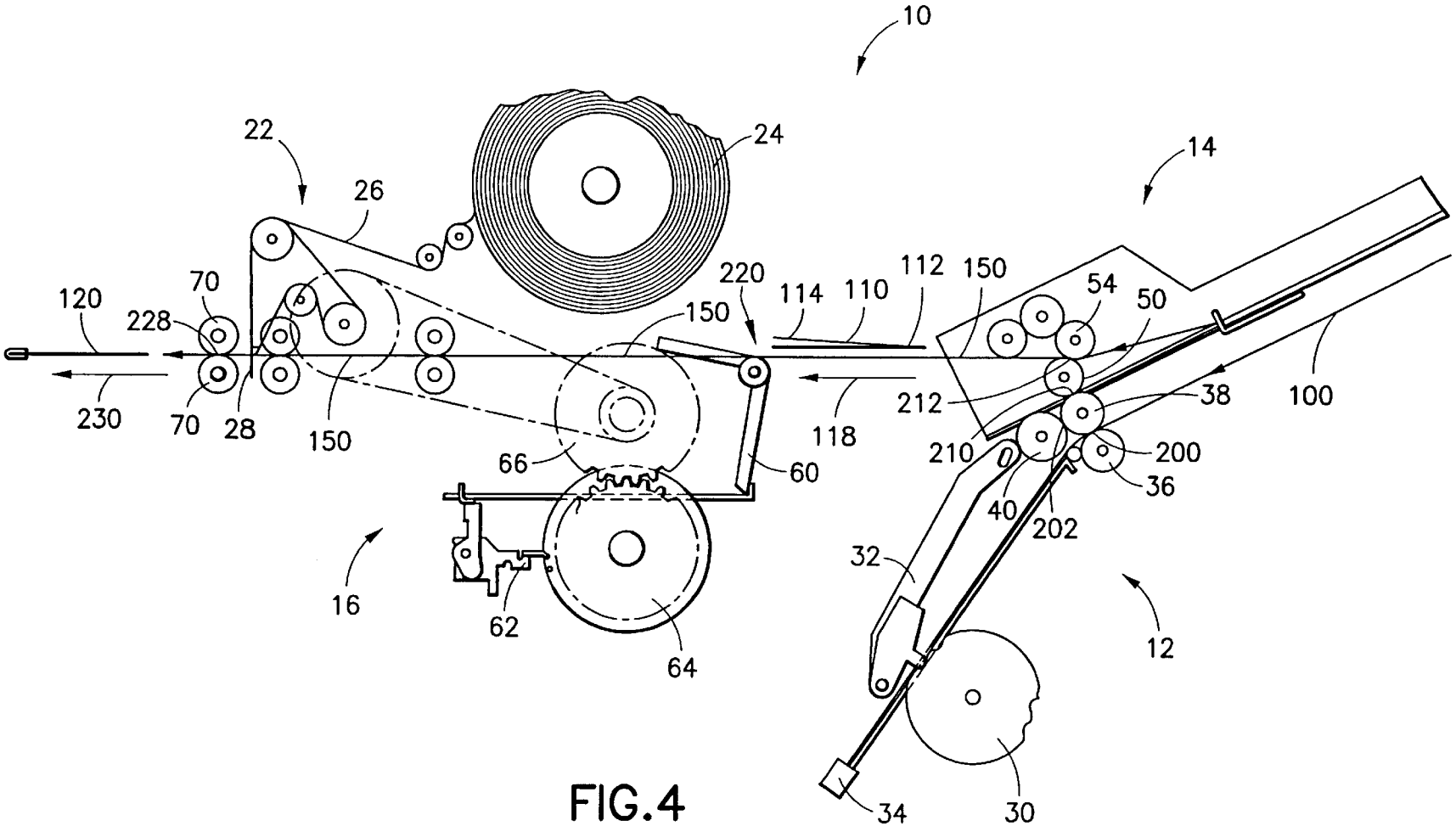
FIG. 4 is a schematic representation of the self-mailer producing system, according to the present invention, showing a continuous path for producing a self-mailer from the input end of the folding material to the exit end of the tabbing apparatus.

Now referring to FIG. 4, the overall path for the self-mailer producing process is denoted by reference numeral 150, which starts at the entrance 200 of the folding apparatus 12 and ends at the exit end 230 of the tabbing apparatus 16. As shown, the folding apparatus 12 comprises a control knob 30 and a control arm 32 for adjusting the position of a stop 34 according to the length of the unfolded material 100 and the type of fold desired. For example, the unfolded material 100 can be folded once or twice. The unfolded material 100 is moved into the folding apparatus 12 at the entrance 200 by a pair of rollers 36 and 38. The unfolded material 100 is folded by rollers 38 and 40 and exits the folding apparatus 12, in this case, at the exit end 202. The folded material is then moved by rollers 38 and 50 into the path directing apparatus 14. As the folded material is stopped by a stop 52, it is moved out of the path directing apparatus 14 by rollers 50 and 54 at the exit end 212.

The folded material 110 continues to move along the path 150 through the entrance 220 of the tabbing apparatus 16. The folded material 110 trips a trip release mechanism 60, which releases a clutch 64 by a releasing mechanism 62, causing the driving mechanism 66 to advance the tape feeder 22. Consequently, a section 28 of the tape 26 from the roll of tape 24 is released into the path 150 of the folded material 110. When the folded material 110 is moved toward the exit rollers 70, its open end 114 contacts the released tape section 28 and causes the released tape section 28 to fold across the open end 114. As the released tape section 28 is dragged along with the folded material 110 into a nip 228 formed by the exit rollers 70, the released tape section 28 is separated from the roll of tape 24 a cutter (not shown). The exit rollers 70 further press the tab 138 (FIGS. 7A and 7B), which is the separated tape section 28, in order to seal the open end 114 of the folded material 10. A self-mailer 120 is thus produced.

As shown in FIG. 4, the path 150 throughout the self-mailer producing system 10 is continuous. From the feeding of the unfolded material 110 to the tabbing of the folded material, all the processing steps are carried out in a continuous flow without interruption. If the folded material 110 is required to be addressed, the address can be put on the folded material 110 either before or after the open end 114 of the folded material 110 is sealed by the tabbing apparatus 16. The address can be put on by applying an address label by a labeling device or printing by a printer. It is also possible and desirable to have a postage indicia to be printed by the printer. The folding, tabbing, printing and labeling can also be carried out in a continuous flow, as shown in FIGS. 5A to 5C.

Figure 5A:
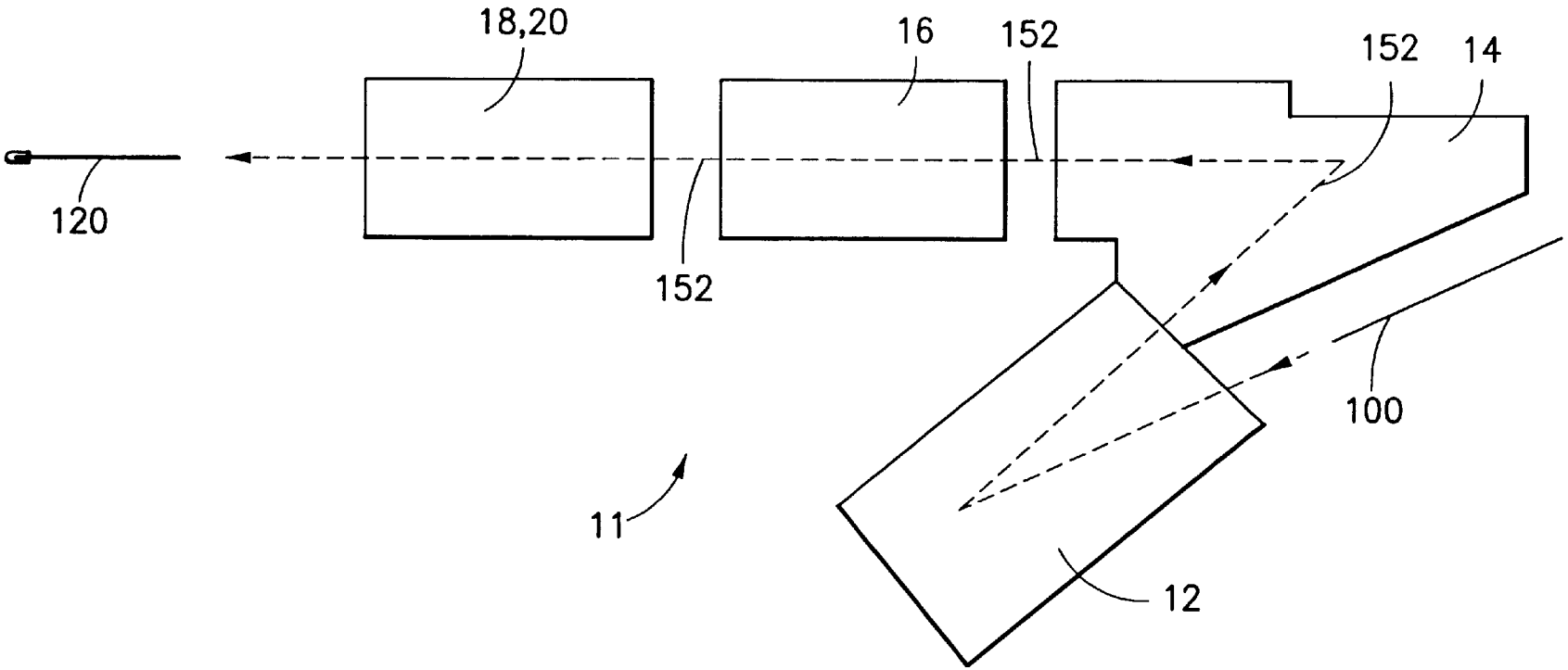
FIGS. 5A to 5C are schematic representations of the self-mailer producing system, showing different arrangements of the various components in the system.

FIG. 5A shows a continuous path 152 throughout a self-mailer producing system 11. In additional to the folding apparatus 12, the path directing apparatus 14 and the tabbing apparatus 16, the self-mailer producing system 11 further comprises a labeler 18 for applying an address label 132 (FIG. 7A) on the self-mailer 120, or a printer 20 for printing an address 136 (FIG. 7B) on the self-mailer 120. The printer 20 can also be used to print a postage indicia 130 (FIGS. 7A, 7B) or a return address 134 (FIGS. 7A, 7B) on the self-mailer 120. As shown, the printer 20 or the labeler 18 is placed downstream from the tabbing apparatus 16 and the path 152 for the entire producing process is continuous. It should be noted that the printer 20 or the labeler 18 can be placed between the path directing apparatus 14 and the tabbing apparatus 16 without affecting the continuous flow of the self-mailer producing process.

Figure 5B:
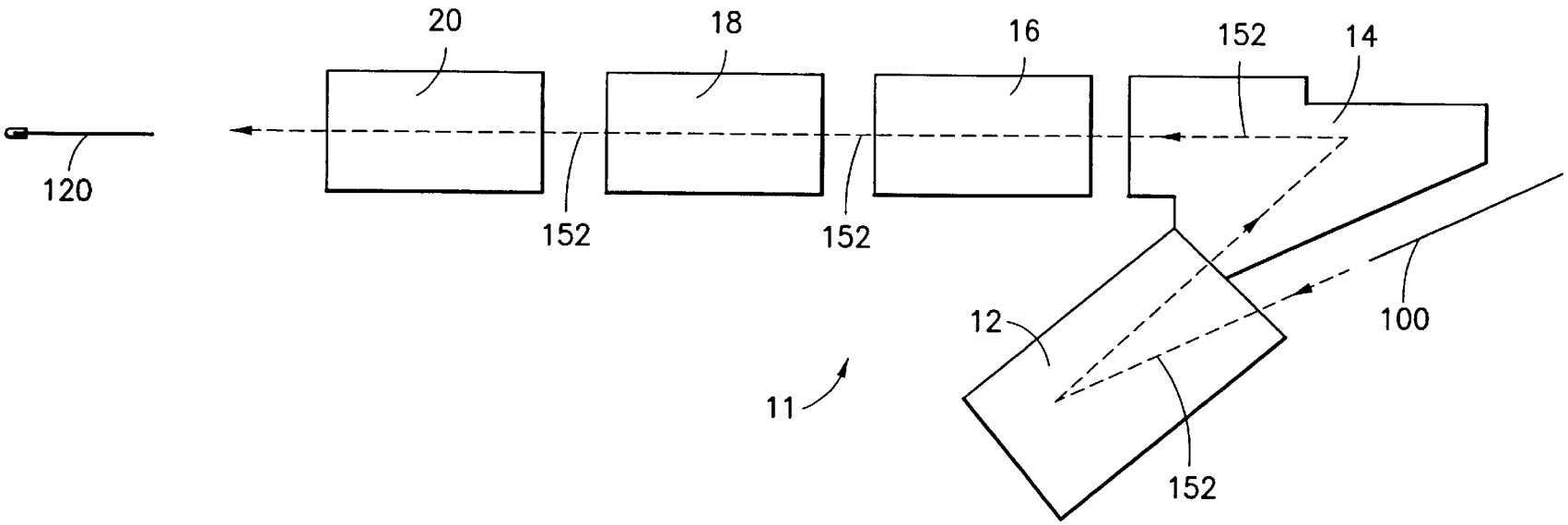

In FIG. 5B, the self-mailer producing system 11 comprises both the labeler 18 and the printer 20. If the labeler 18 is used to put an address label 132 on the self-mailer 120, then the printer 20 can be used to print an indicia 130 and a return address 134. As shown, the path 152 for the entire producing process is continuous. It should be noted that the position of the printer 20 and the position of the labeler 18 can be interchanged such that the printer 20 is placed between the labeler 18 and the tabbing apparatus 16. Furthermore, either or both the printer 20 and the label 18 can be placed between the tabbing apparatus 16 and the path directing apparatus 14.

Figure 5C:
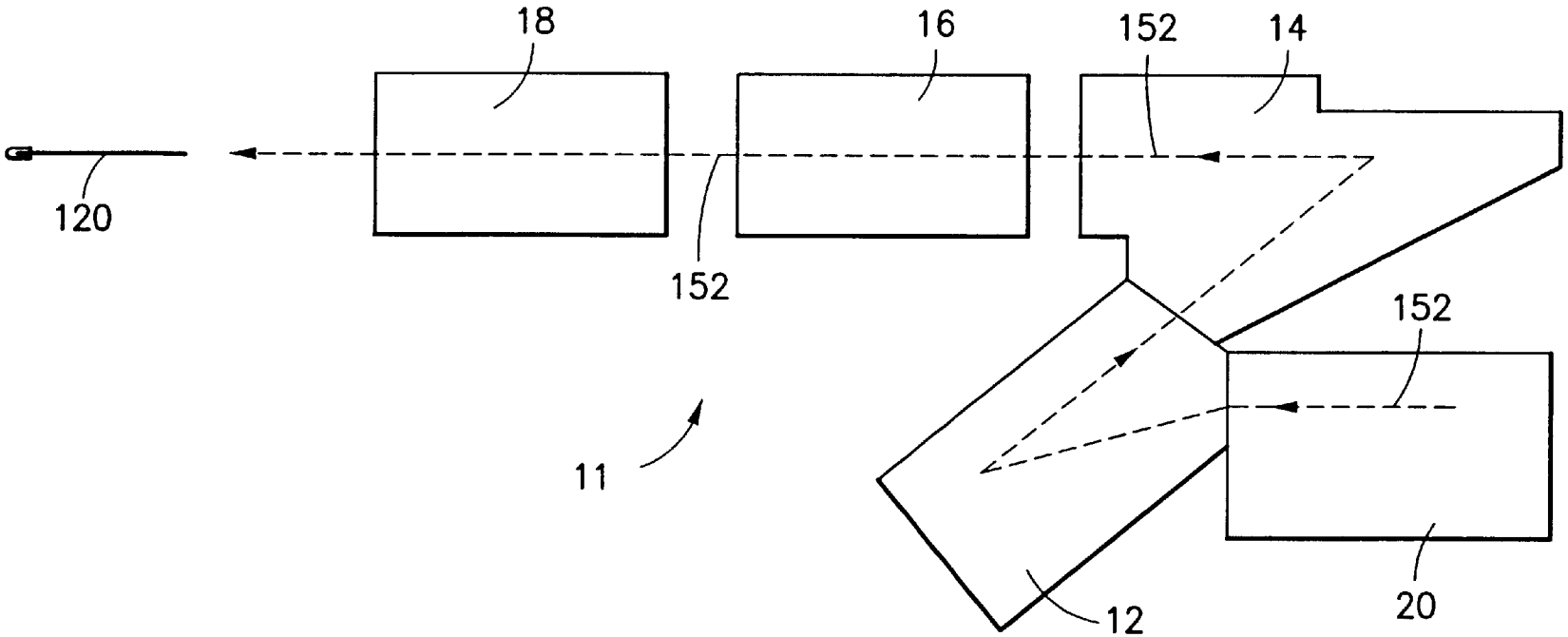

FIG. 5C shows another arrangement of the components of the self-mailer producing system 11. As shown, the printer 20 is placed upstream from the folding apparatus 12.

Figure 6A:
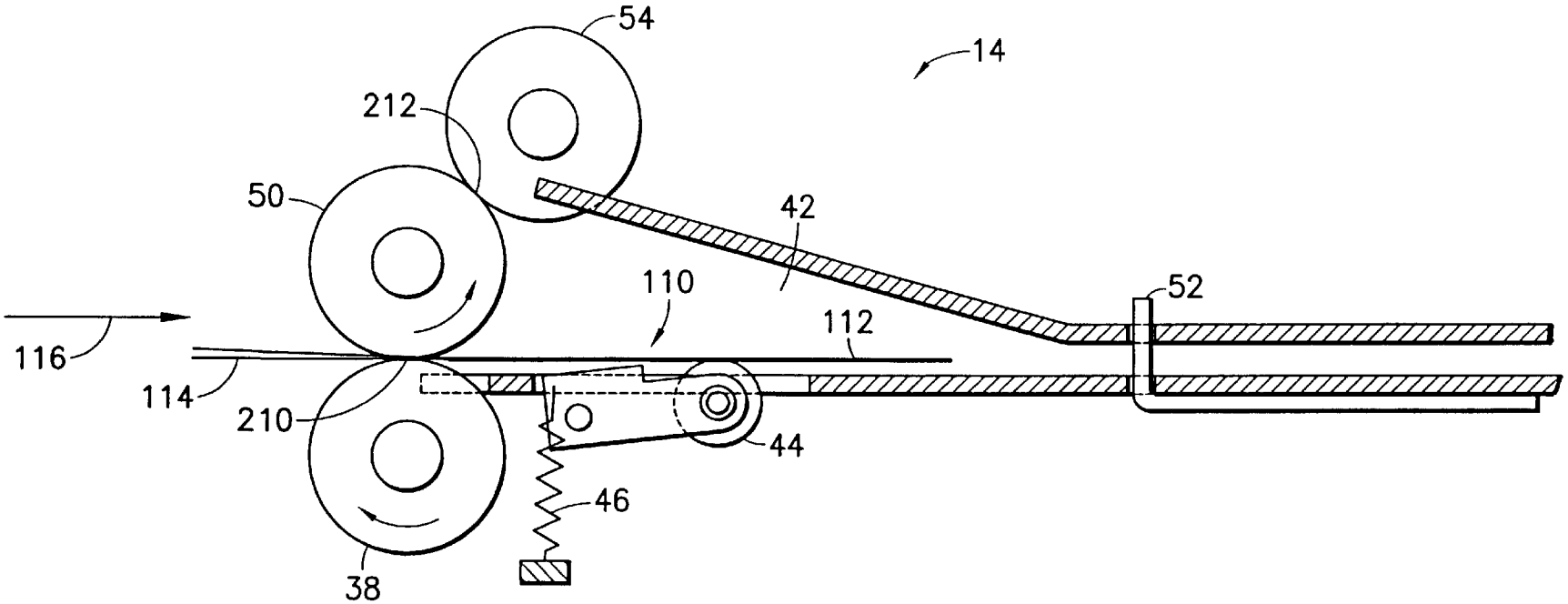
FIGS. 6A and 6B are schematic representations of a path directing apparatus, showing the principle of path directing.
Figure 6B:
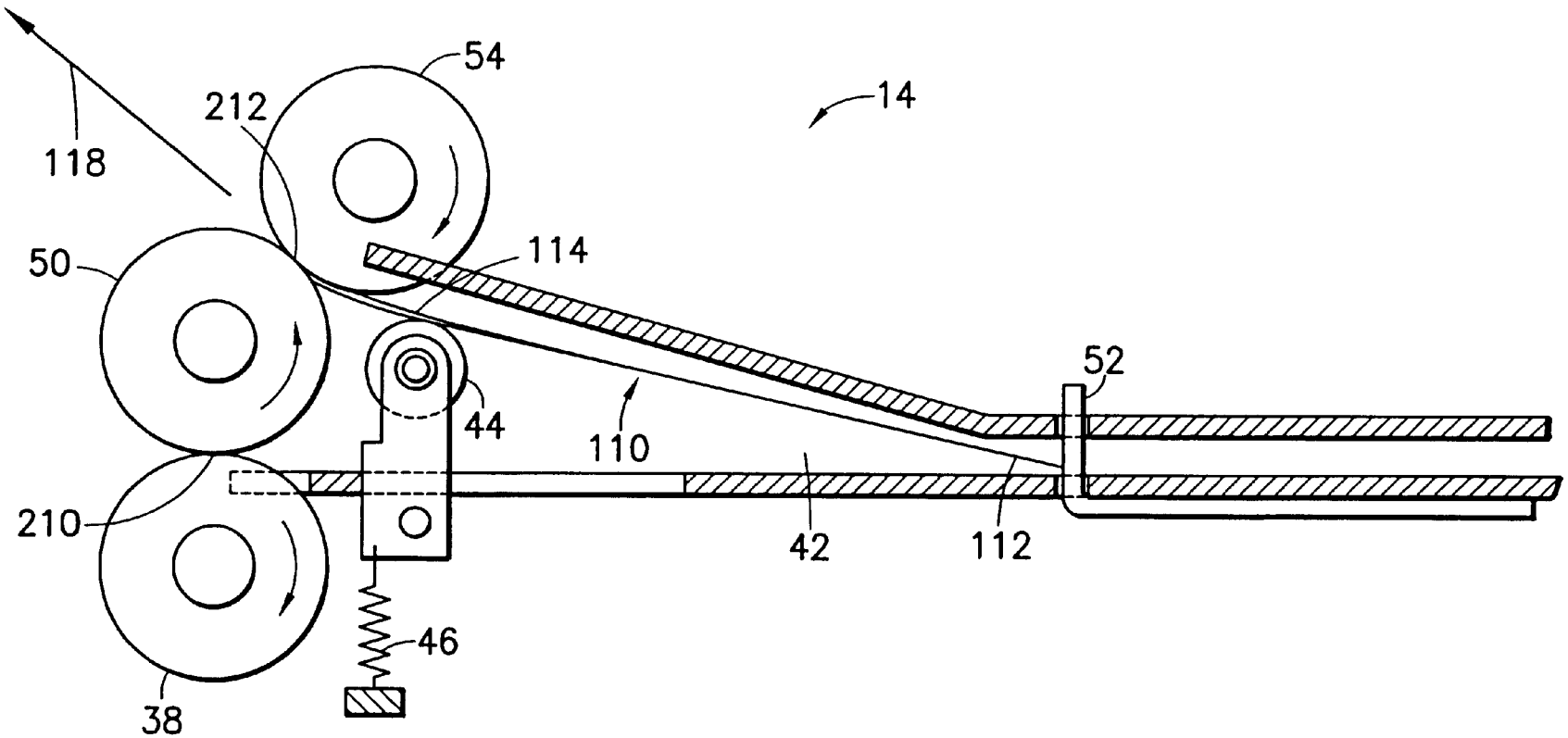

The principle of path directing is illustrated in FIGS. 6A and FIG. 6B. As shown in FIG. 6A, the folded material 110 is drawn into a turn chute 42 of the path directing apparatus 14 by rollers 38 and 50. Originally, the spring loaded roller 44 is at an upright position. As the leading edge 112 (the folded end) of the folded material 110 is moved into the turn chute 42, it depresses the spring loaded roller 44 until the leading edge 112 is stopped by the stop 52. Even after the leading edge 112 of the folded material 110 is stopped by the stop 52, the trailing edge 114 (the open end) of the folded material 110 is still moved into the turn chute 42 by the roller nip 210. Because the distance between the stop 52 and the nip 210 of the rollers 38 and 50 is slightly shorter than the length of the folded material 110, the trailing edge 114 of the folded material 110 starts to buckle and the spring loaded roller 44 starts to move back to its original position with the help of a spring 46. Once the trailing edge 114 of the folded material 110 is disengaged from the roller nip 210, with the help of the rotating roller 50 and the urging force of the returning spring-loaded roller 44, the open end 114 of the folded material 110 is raised and moved toward the roller 54. Because the distance between the stop 52 and the nip 212 formed by roller 50 and 54 is also slightly shorter than the length of the folded material 110, the open end 114 of the folded material 110 is caused to be engaged with the rollers 50 and 54, as shown in FIG. 6B. Subsequently, the folded material 110 is moved out of the path directing apparatus 14 by rollers 50 and 54, along the direction 118.

Figure 7A:
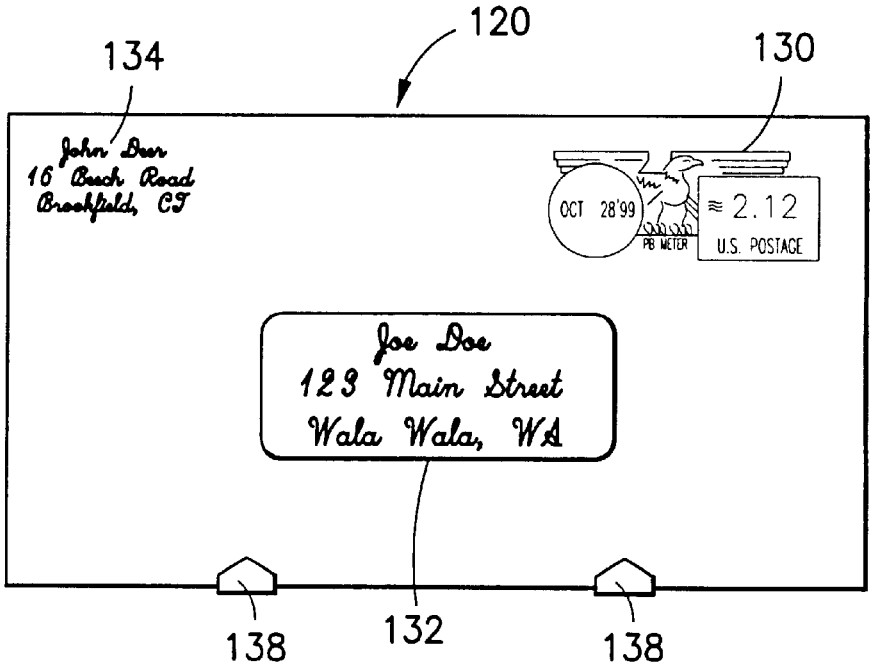
FIGS. 7A and 7B illustrate a typical self-mailer.
Figure 7B:
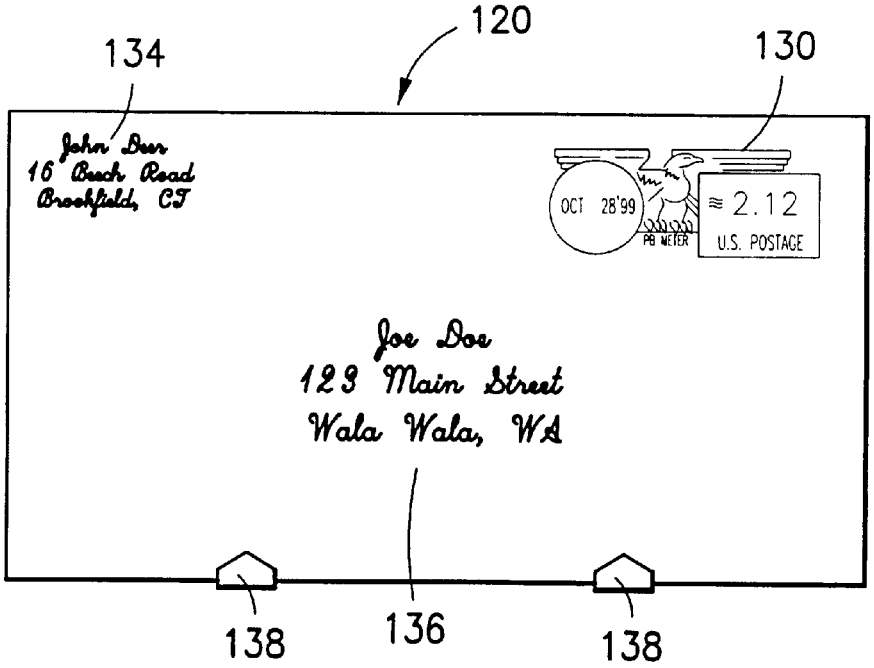

FIG. 7A shows a self-mailer 120 having a postage indicia 130, an address label 132 and a return address 134. As shown, the self-mailer 120 is sealed by two tabs 138, but it can be sealed by one or more tabs 138. In FIG. 7B, instead of the address label 132, the address is printed directly on the self-mailer 120 as denoted by reference numeral 136.

Although the invention has been described with respect to a preferred version and embodiment thereof, it will be understood by those skilled in the art that the foregoing and various other changes, omissions and deviations in the form and detail thereof may be made without departing from the spirit and scope of this invention.

What is claimed is:

1. A system for producing self-mailers comprising a sheet folding and tabbing unit, the sheet folding and tabbing unit comprising:

(a) a folding apparatus for folding sheets into folded pieces, wherein each folded piece has an open end and an opposing end, and wherein the folding apparatus has an exit end and the folded piece exits the exit end of the folding apparatus with the open end trailing the opposing end;

(b) a tabbing apparatus for sealing the folded piece at the open end thereof in order to produce a self-mailer, wherein the tabbing apparatus has an input end; and (c) a path directing apparatus located between the exit end of the folding apparatus and the input end of the tabbing apparatus, the path directing apparatus comprising a turn chute for directing the folded material into a flow path whereby a trailing end of the folded material immediately becomes a lead end so as to cause the folded piece to enter the input end of the tabbing apparatus with the open end leading the opposing end.

2. The system of claim 1, wherein the opposing end of the folded piece is a folded end.

3. The system of claim 1, further comprising a labeling device located adjacent to the tabbing apparatus for applying at least a label on the folded piece, wherein a continuous path is provided between the labeling device and the tabbing apparatus so as to allow the folded piece to move between the labeling device and tabbing apparatus, without interruption.

4. The system of claim 3, wherein the system has an upstream end and a downstream end, and wherein the labeling device is located upstream from the tabbing apparatus.

5. The system of claim 3, wherein the system has an upstream end and a downstream end, and wherein the labeling device is located downstream from the tabbing apparatus.

6. The system of claim 3, wherein the label is an address label.

7. The system of claim 1, further comprising a printer located adjacent to the tabbing apparatus for printing on the folded piece, wherein a continuous path is provided between the printer and the tabbing apparatus so as to allow the folded piece to move between the printer and tabbing apparatus without interruption.

8. The system of claim 7, wherein the system has an upstream end and a downstream end, and wherein the printer is located upstream from the tabbing apparatus.

9. The system of claim 7, wherein the system has an upstream end and a downstream end, and wherein the printer is located downstream from the tabbing apparatus.

10. The system of claim 7, wherein the printer prints an address on the folded piece.

11. The system of claim 7, wherein the printer prints a postage indicia on the folded piece.

12. The system of claim 1, wherein the path directing apparatus comprises:

(a) the turn chute having a front end and an opposing rear end;

(b) a first nip located at the front end for ingesting the folded pieces, one at a time, into the turn chute with the open end trailing the opposing end;

(c) a second nip located adjacent to the first nip;

(d) a stop located at the rear end for stopping the ingested folded piece; and (e) means for causing the open end of the ingested folded piece to be disengaged from the first nip and engaged with the second nip so as to allow the second nip to move the ingested folded piece out of the turn chute with the open end leading the opposing end.

13. The system of claim 12, wherein the causing means comprises a spring-loaded roller located near the first nip within the turn chute to urge the open end of the ingested folded piece to move away from the first nip towards the second nip.

14. The system of claim 12, wherein the first nip comprises two rollers.

15. The system of claim 12, wherein the second nip comprises two rollers.

* * * * *